US008668547B2

(12) United States Patent
Boonen et al.

(10) Patent No.: US 8,668,547 B2
(45) Date of Patent: Mar. 11, 2014

(54) NURSING BRA

(75) Inventors: Eva Boonen, Zoutleeuw (BE); Martine Boonen, Hechtel (BE)

(73) Assignee: BEAUnen bvba, Hasselt (BE)

( * ) Notice: Subject to any disclaimer, the term of this patent is extended or adjusted under 35 U.S.C. 154(b) by 237 days.

(21) Appl. No.: 12/998,844

(22) PCT Filed: Dec. 17, 2009

(86) PCT No.: PCT/EP2009/067395

§ 371 (c)(1),
(2), (4) Date: Jun. 7, 2011

(87) PCT Pub. No.: WO2010/070042

PCT Pub. Date: Jun. 24, 2010

(65) Prior Publication Data

US 2011/0237156 A1 Sep. 29, 2011

(30) Foreign Application Priority Data

Dec. 17, 2008 (BE) ..... 2008/0678
Aug. 6, 2009 (BE) ..... 2009/0477

(51) Int. Cl.
*A41C 3/00* (2006.01)

(52) U.S. Cl.
USPC ..... 450/36; 450/54; 450/58

(58) Field of Classification Search
USPC ..... 450/36, 54–57, 37, 38; 2/267
See application file for complete search history.

(56) References Cited

U.S. PATENT DOCUMENTS

| | | | | |
|---|---|---|---|---|
| 2,890,702 | A * | 6/1959 | Farino | 450/36 |
| 3,203,424 | A * | 8/1965 | Garutso | 450/68 |
| 3,439,682 | A * | 4/1969 | Defru | 450/36 |
| 4,633,876 | A | 1/1987 | Scullin | |
| 5,380,238 | A * | 1/1995 | Crew-Gee | 450/36 |
| 6,227,936 | B1 * | 5/2001 | Mendoza | 450/36 |
| 6,319,092 | B1 * | 11/2001 | Leyhe et al. | 450/36 |
| 7,081,034 | B1 * | 7/2006 | Zoellner | 450/54 |
| 7,118,444 | B2 * | 10/2006 | Newman | 450/58 |
| 7,878,880 | B2 * | 2/2011 | Hendrickson | 450/36 |
| 7,878,881 | B2 * | 2/2011 | Hendrickson | 450/36 |
| 2004/0016039 | A1 * | 1/2004 | Caprio | 2/73 |
| 2008/0022434 | A1 * | 1/2008 | Adelman | 2/104 |

FOREIGN PATENT DOCUMENTS

| | | | |
|---|---|---|---|
| AU | 2006200947 | A1 | 9/2006 |
| GB | 2 287 640 | A | 9/1995 |

OTHER PUBLICATIONS

The International Search Report dated Mar. 15, 2010 for PCT Application No. PCT/EP2009/067395.

* cited by examiner

*Primary Examiner* — Gloria Hale
(74) *Attorney, Agent, or Firm* — Amster, Rothstein & Ebenstein LLP

(57) ABSTRACT

Nursing bras with at least one cup (1) for supporting a breast, wherein the cup comprises a first part (2) for supporting of the breast, characterized in that the cup is provided with a second part (4) which at least in part overlaps with the first part (2).

14 Claims, 13 Drawing Sheets

NURSING BRA

This is a U.S. national phase of PCT Application No. PCT/EP2009/067395, filed Dec. 17, 2009, which claims the benefit of Belgian Patent Application No. 2008/0678, filed Dec. 17, 2008 and Belgian Patent Application No. 2009/0477, filed Aug. 6, 2009.

This invention relates to a nursing bra as described in the claims, comprising an inner bra and a top part, which can be opened by a closing mechanism centrally on the inner bra between the two breasts.

STATE OF THE ART

Nursing bras are known in the art but have the disadvantage of being awkward and not very aesthetic and in some cases they do not make it possible to breastfeed discretely.

A typical nursing bra has cups which can be opened at the top to free the breast for feeding the baby. When a cup of a traditional breastfeeding bra is opened, the major part of the breast is exposed, even when the baby is brought to the breast. De closure above the cup is not very practical for opening the bra one-handedly. Most nursing bras also have a simple and not very aesthetic design.

The use of breast pads, for collecting the milk that is discharged between breast feedings, is unavoidable for most women. These however often do not prevent some milk from seeping through to the bra and sometimes the clothing. In addition, the manipulation of a breast pad while holding the baby to the breast is not practical.

In the Australian patent application AU2006200947, a breastfeeding bra is described which has a supportive part and a breast-covering part. The top part is released and both parts are separated from each other to free the breast for breastfeeding. U.S. Pat. No. 7,448,936 describes a nursing bra with a cup which can be folded open, whereby on the inside of the cup a breast pad holder has been placed. The holder has been designed such that, when the pad is placed therein, it can collect any eventual loss of milk by the breast which occurs during the wearing of the bra. Upon folding open the cup, a large part of the breast is exposed. In Japanese patent application JP8127904, a nursing bra is described which contains a breast-supportive part and a breast-covering part. The breast-covering part can be attached by way of a closure in the centre of the bra, between the two breasts. Also in this bra, the major part of the breast becomes visible upon folding open of the breast-covering part.

The nursing bras described in the state of the art accordingly do not offer the combination of discretion, functionality and comfort.

SUMMARY OF THE INVENTION

It is an object of the present invention to develop a nursing bra which is more practical in use, is more pleasant to wear and is more aesthetical.

To achieve this, the nursing bra has a number of features which ensure a significant improvement compared to previously developed designs.

According to a first aspect of the present invention nursing bras are provided, comprising (a) an inner bra whereby a cup of the inner bra comprises a first part (2) for supporting the breast and a second part (4) which overlaps in part with the first part (2), whereby the first part (2) and the second part (4) can be pushed apart for freeing up at least part of the nipple of the breast upon breastfeeding;

and (b) at least one top part (3) which can be opened through a closure centrally on the inner bra between the two breasts.

In particular embodiments of the nursing bras according to the present invention, the top part (3) covers the first part (2) and the second part (4) of a cup of the inner bra only in part.

In further embodiments, the top part (3) comprises means for storing a breast pad when this top part (3) is detached from the inner bra. In more particular embodiments, each of the top parts comprises a net structure on the inside.

In particular embodiments of the nursing bras according to the invention, each of the top parts (3) comprises a net structure on the inside.

In particular embodiments of the nursing bras according to the invention, the first part (2) can contain on the inner side an additional layer of supporting fabric.

In particular embodiments of the nursing bras according to the invention, the first part (2) extends up to and hangs on to the shoulder strap of the nursing bra.

In particular embodiments of the nursing bras according to the invention, the first part (2) supports the breast upon wearing by the presence of an under wire on the bottom of the first part (2), which follows the contour of the lower side of the breast and extends towards the armpit.

A nursing bra according to the invention can in some embodiments comprise a closure of the top parts. More particularly, in some embodiments this closure comprises a hook and tongue system, which contains an additional recess at the bottom of the hook to provide for additional resistance and to allow that the closing of the top parts can be clearly sensed.

The nursing bras according to the present invention comprise one or more, and in particular all of the above-described features.

According to a further aspect, a nursing bra according to the present invention is provided in combination with one or more breast pads.

According to particular embodiments of this combination, at least one of the two sides of the one or more breast pads is provided with a design and/or a fabric which matches with or is identical to the fabric of the inner bra and/or the top parts (3) of the nursing bra. The invention further provides breast pads for use in combination of the nursing bra according to the invention, which are provided with a design and/or fabric which matches with or is identical to the fabric of the inner bra and/or the top parts (3) of the nursing bra according to the present invention.

According to yet a further aspect, the invention provides the use of a nursing bra according to the present invention or of a combination of a nursing bra according to the invention with one or more breast pads for the support and/or covering of the breasts.

DETAILED DESCRIPTION OF THE INVENTION

In this description, the following definitions will be referred to.

The term "nursing bra" as used herein refers to a bra which is specifically designed for breast feeding, more particularly which makes it possible to breastfeed and/or to pump milk from a breast without the bra having to be removed.

The term "cup" as used herein refers to one or more parts of a bra which contain the breast.

The term "in closed state" as used in the present description when referring to a nursing bra, and more particularly to the top part of a nursing bra, refers to the bra or part thereof when both or one of the top parts of is latched onto the inner bra by way of the closing mechanism. This is the configuration of the nursing bra on moments that no breastfeeding takes place.

The term "in open state" as used in the present description when referring to a nursing bra and more particularly to the top part of a nursing bra, refers to the bra or parts hereof when both or one of the top parts of the is not attached to the inner bra via the closing mechanism, and typically do not cover it. This is the preferred configuration of the nursing bra during those moments when breastfeeding takes place.

The term "inner side" as used herein referring to the nursing bra or one of her parts, refers to the side that has contact with or is at the side of the breast when the bra is being worn.

The term "outer side" as used herein refers to the side of the bra or part thereof which is at the opposite side of the inner side.

The term "side part" as used herein, more particularly for the nursing bra or a part thereof, refers to the side of the bra or the part thereof which, when the bra is being worn, is close to the armpit.

When reference is made herein to the 'middle' of the nursing bra, this refers to the region between the two cups, i.e. between the breasts when the bra is being worn.

The term "upper side" when referring to a breast or a part of a nursing bra, refers to that part of the breast that is located above the nipple (in the direction of the neck) when the bra is being worn.

The term "lower side" refers in a similar way to the region of the breast which is located under the nipple (in the direction of the stomach), when the bra is being worn.

According to a first aspect of the invention, nursing bras have been developed which have a number of features which make wearing the bra and breastfeeding in less obvious places, considerably easier.

In a first embodiment of the invention, nursing bras are provided which (a) contain an inner bra whereby each cup comprises a first part (2) for support of the breast and a second part (4) which overlaps in part with the first part (2) and which further comprises, for each cup of the inner bra (b) a top part (3) which can be opened through a closing mechanism located centrally on the inner bra between the two breasts.

The first part (2) and the second part (4) of the cups of the inner bra are both provided in a resilient fabric such that these parts can be pulled manually over and off the breast. Suitable resilient fabrics are known to the skilled person and include amongst others Lycra, Spandex, Nylon, polyester, polyamide, elastane and combinations hereof such as Lycra/Spandex Power Net or Powerknit. One suitable fabric can be a fabric consisting of about 85% polyamide and about 15% elasthanine.

These parts consist of different parts of fabric even though in most embodiments they are attached to each other, for instance sewn onto each other, on the side part of the bra. The first part (2) and the second part (4) can each be pulled off the breast to one side such as to (further) free the nipple and areola during breastfeeding. Herein, the first part (2) is moved in the direction of the lower side of the breast, while the second part (4) is moved in the direction of the upper side of the breast.

The resilient material of the first part (2) and the second part (4) can, more particularly towards the outer side, be provided with particular patterns and/or designs and/or stitching which embellish the view of the inner bra.

In the nursing bras according to the present invention, the first part (2) of the cup of the inner bra has mainly a supporting function.

In particular embodiments, the first part (2), is provided on the inner side with an additional layer of fabric, which provides additional support. In more particular embodiments, this fabric is a net-like fabric. Suitable net-like fabrics are known to the skilled person and can consist of, amongst others, polyester and/or Spandex and/or suitable combinations thereof.

The supporting function of the first part (2) can moreover in particular embodiments be emphasized by the fact that this first part (2) expands on the side part and hangs on to the shoulder strap. The consequence of this is that the first part (2) lifts up the breast when the bra is being worn. Additionally or independently thereof, the supporting function of the first part (2) can be emphasized in particular embodiments by the presence of an under wire, which supports the breast. More particularly, the form of the under wire can be provided to support the shape of a milk-carrying breast from below. This implies that the under wire follows the circumference of the lower side of the breast, from the center of the bra between the two breasts going up to the armpit.

In more particular embodiments, the first part (2) of the inner bra has an approximately triangular shape whereby one side follows the lower side of the breast, one side aligns the side of the breast and one side runs diagonally over the breast from the middle part of the inner bra to about the position where the shoulder strap starts. This last side can in particular embodiments be provided such as to cross over the breast above the nipple, such that the first part (2) covers the nipple when the bra is being worn. In other embodiments this last side of the first part (2) runs under the nipple when wearing the bra, such that this first part (2) of the inner bra does not cover the nipple.

In the nursing bras according to the present invention, the second part (4) of the cup of the inner bra has mainly a covering function. The second part (4) covers the upper part of the breast. In particular embodiments the second part (4) extends diagonally over the upper part of the breast, from the middle of the inner bra up to the shoulder strap, at the level of the armpit. In particular embodiments, the shape of the second part of the inner bra corresponds approximately with a rectangle with one concave side. The straight side is positioned on the upper part of the breast and forms the cleavage or excision of the inner bra. The concave side crosses over the breast just above or just under the nipple such that the second part (4) covers or does not cover the nipple.

The first and the second part of the inner bra are, as described above, not attached to each other at those sides which cross over the breast. In particular embodiments the two parts (2) and (4) of the inner bra cover the breast completely when the bra is being worn and there is no breastfeeding taking place. In other embodiments of the nursing bra the two parts (2) and (4) of the inner bra cover the breast only partially in such a way that the two parts (2) en (4) of the inner bra form a recess, i.e. an opening (6) where the breast is not covered by the inner bra when the bra is being worn (and no breastfeeding is taking place). According to particular embodiments of the invention the nursing bra is provided such that, upon placing a breast pad on the inner side of the inner bra, this opening is completely covered by the breast pad (see the description of the breast pad below).

In particular embodiments, the nursing bras have the feature that with regard to the cup of the inner bra, the second part is provided such that it partly overlaps with the first part. More particularly, in particular embodiments of the invention it is envisioned that one of the two sides of respectively the first part (2) and the second part (4) of the inner bra which are adjoined to each other, (almost completely) overlaps with the other such that the breast is (almost) completely covered when the bra is being worn when no breastfeeding is taking place. In that case, there is no or only a very small opening (6) between the two parts (2) and (4). More particularly, in particular embodiments of the nursing bra, it is envisioned that, in the area where the first part (2) and the second part (4) are attached to the other parts of the inner bra (i.e. at the level of the middle part and on the side part) these parts are wider and overlap in part. In particular embodiments it is envisioned that this overlap is limited, such that the two parts (2) and (4) of the inner bra form a recess, i.e. and opening (6) where the breast is not covered by the inner bra when the bra is being worn and no breastfeeding is taking place. In these embodiments, the shape of the opening (6) is oval or ellipsoid. The width of the opening (6) at its widest point can range from a few millimeters to a few centimeters.

The inventor has found that such nursing bras which comprise an inner bra according to the present invention, are more practical in use compared to the known nursing bras and offer both more comfort and discretion and privacy during breastfeeding. The assembly or the combination of the first part (2) and the second part (4) results in both support and sufficient coverage of the breast, while providing the possibility of uncovering the nipple and, if required, the aureola, during breastfeeding, by sliding apart the first and the second part.

The nursing bras of the present invention further comprise, for each cup of the inner bra, a top part (3). This top part (3) is attached to the inner bra on the side part of the cup and can be opened by way of a closing mechanism centrally on the inner bra between the two breasts, i.e. through a closing mechanism in the centre of the inner bra.

In particular embodiments, the top part (3) covers the cup of the inner bra only in part. In these embodiments part of the first (2) and/or the second (4) part of the cup of the inner bra remains visible when the bra is being worn in closed state. In alternative embodiments the top part (3) covers the cup of the inner bra, and thus the breast surface, completely.

In particular embodiments, the top part (3) is provided at least on the outer side and optionally also on the inner side with a fabric which matches with or is identical to the fabric of the inner bra.

In particular embodiments, the top parts are mad in relatively thick fabric and/or the top parts are lined. This has the advantage that they ensure a smooth shape of the breasts on the outside and that breast pads which may be present do not make an imprint or shine through the fabric of the top part (3). Additionally, this additional layer can serve to adsorb potential moisture such as milk and to avoid stains on clothing. In this way, the top parts (3) ensure that the nursing bras according to the invention provide a nice apparition, i.e. both by way of the smooth surface and by way of the fabric from which they are manufactured, and provide in addition protection against potential leaking of the breasts.

The nursing bra according to the present invention is, in particular embodiments, envisioned to be worn with breast pads.

Breast pads are typically worn during breastfeeding to protect the bra and cloths against the leaking of milk by the breasts. When using the nursing bra according to the present invention, the breast pads are worn on the inner side of the inner bra. This prevents the milk from moisturizing the inner bra. Additionally, the breast pad can make the wearing of the bra more comfortable, as in this case the linings of the first and second part of the inner bra do not press directly on the breast. In particular embodiments, the nursing bra, and more particularly the inner bra and the top parts are adjusted in size for this specific purpose.

As detailed above, in particular embodiments, the inner bra of the nursing bra according to the present invention has a recess. This recess between the first (2) and the second part (4) of the inner bra of the nursing bra is, when present, provided such that the breast is completely covered when wearing a breast pad on the inner side of the inner bra. In particular embodiments the cross section of the opening is (in all directions) smaller than that of a standard breast pad, i.e. typically less than 7 cm. Generally the cross section of the opening is less than 5 cm. For particular embodiments, breast pads can be provided with a particular size, which ensures that the breast is completely covered by the inner bra when the nursing bra is being worn with the breast pads.

One or more of the following features of particular embodiments of the nursing bra according to the invention additionally contribute to the fact that the breast pad, when it is placed in the inner bra, is maintained in an appropriate position on the breast: (1) the inner bra covers a considerable part of the surface of the breast, (2) the presence of a first and a second part in the inner bra and (3) the resilience of the material of the inner bra.

The nursing bra according to the invention can be worn in combination with most standard types of breast pads, including disposable breast pads and breast pads made of fabric, whereby, for instance the breast pads made of fabric can be, for instance, washable breast pads made of fabric. Use can also be made of breast pads which contain at least on one side a fabric which is the same as or assorted with the fabric of the inner bra and/or the top parts of the bra. This emphasizes the aesthetic effect when the bra is being worn as well as when the breast pads need to be removed.

In particular embodiments of the nursing bra according to the present invention, the top part (3) of the nursing bra is provided with a means to store a breast pad during breastfeeding. As described above, a breast pad is worn on the inner side of the inner bra against the breast and it must be removed before breastfeeding can be started. According to these embodiments, upon removing the breast pad from the inner bra, the breast pad can be temporarily stored on the inner side of the top part (3) which has been folded open to free the breast. Each of the top parts (3) is typically provided with a breast pad holder for this purpose, such as for instance a net. The breast pad holder is typically attached to the inner side of a top part (3), for instance by way of stitching. In particular embodiments, the breast pad holder, which is present on the inner side of a top part (3) is designed such that it allows very easy handling, more particularly with one hand if necessary, for storage of a breast pad therein.

A breast pad holder comprises, according to particular embodiments an opening through which the breast pad can be introduced and/or slid in and a part which retains the breast pad and/or covers it when the breast pad is present in the breast pad holder.

A breast pad holder of a top part (3) according to the present invention can in principle have any shape. Additionally, the dimensions and the position of the opening of the breast pad holder are not limited to particular embodiments. One breast pad holder can for instance be a small bag which covers the inner side of the top part (3) either in part or (almost) completely, whereby the opening of the holder is positioned at the upper side or at one of the sides of the top part (3). The shape of the bag is not limited in any way, provided that the breast pad can be easily stored therein and can for instance be circular or rectangular. In particular embodiments, the dimensions of the breast pad holder are larger than those of the breast pad such that the breast pad, when it is introduced into the holder, is at least in part or for the most part covered by the fabric of the breast pad holder. It is the intention that the breast pad can be stored in the holder and that it is kept therein, despite the fact that the top part (3) as such is not closed, and thus hangs open. In more particular embodiments, the holding of the breast pad is ensured when the breast pad is covered for at least 50% by the breast pad holder.

In particular embodiments, the breast pad holder is formed by a layer of fabric or a net which covers a part of the inner side of the top part, more particularly covers it for the major part.

In particular embodiments of the nursing bra according to the present invention, the two parts (2) and (4) of the inner bra (upon wearing) form a recess at the level of the nipple and the breast pad holder is formed by a bag which covers the inner side of the corresponding top part (3) in part or (almost) completely.

The nursing bra according to the present invention is further characterized in particular embodiments by a closing mechanism which allows opening and closing of the top parts and is positioned on the inner bra between the two cups. The provision of access to the breast by way of the center of the bra makes it easier to open the bra, such that this can be done with one hand if necessary. By doing this, the outside of the bra is in addition folded open horizontally, which allows the provision of a breast pad holder which is easily accessible but at the same time tightly retains the breast pad. The closing mechanism is in particular embodiments adapted for closing of both top parts, but each of the top parts can also be serviced by a completely separate closing mechanism.

In particular embodiments, the closing mechanism is provided as a hook and tongue system. The hook system is attached on the middle part of the nursing bra. Where the closing mechanism is adjusted for the closing of both top parts, i.e. for hooking of two tongues, the hook system comprises two hooks which are oriented in opposite direction, i.e. each to one side part of the bra. Each of the two hooks is intended to attach one of the top parts by way of a tongue. In particular embodiments, the hook can comprise an additional recess. This recess can be formed by the presence of an additional element, which is positioned on the hook system on the opposite sides of the end of the hook and which forms an additional obstacle which further narrows the size of the opening formed by the end of the hook and the base of the hook system. This element can take whatever form provided the presence of this element ensures additional resistance upon closing of the top part (3) by hooking in of the tongue. This element can for instance be a small ball which has been created on the base of the hook system right across from the end of the hook. By the presence of an additional element on the hook system which provides additional resistance, an additional recess is provided on the lower side of the hook and this requires that the tongue part must be clicked over the hook instead of just being hooked in such that the top parts (3) can not come loose unnoticed but can still be easily hooked loose with one hand. The tongue system consists of one or two tabs of which each one is attached on a top part (3) of the bra at the level of the center of the bra in the closed state.

The nursing bra according to the present invention comprise a number of parts which are not described herein in detail, but are known to the person skilled in the art, such as shoulder straps, a back part which spans the back and optionally a closing system for the opening and closing of the complete bra for putting it on and taking it off. The embodiments of these parts are not critical for the present invention. While for the nursing bra according to the invention one single cup (1) is sufficient, the embodiment comprising two cups (1) is preferred as in this embodiment both breasts are supported. One single cup (1) can also be used however in case one of the breasts has been amputated.

A further aspect of the present invention provides a combination of a nursing bra according to one or more of the embodiments described above, with one or more breast pads. More particularly, in particular embodiments of this combination at least one of the two sides of each breast pad is provided with a pattern, more particularly a fabric which matches with or is identical to the fabric of the inner bra and/or the top parts. In particular embodiments, the fabric is identical to the fabric of the outer side of the first part (2) and the second part (4) of the cup of the inner bra. The present invention further provides combinations of the nursing bra according to one or more of the above-described embodiments with one or more disposable breast pads, provided with particular patterns which match with the patterns of the bra. The embodiment of the breast pad is not critical. In particular embodiments, the breast pad is circular and provided with several layers to further the absorbing features thereof. The technical features of the breast pads which comply with these requirements are known to the skilled person.

In a particular embodiment of the combination of the nursing bra with one or more breast pads according to the invention, the top part (3) of the nursing bra is provided with a breast pad holder as described above such that in accordance with the present invention, the breast pad, which is removed from the inner bra during breastfeeding, can be easily stored in the corresponding top part (3) which has been folded open for releasing the breast.

A further aspect of the invention relates to the use of a nursing bra according to the invention and/or a combination of a nursing bra with one or more breast pads according to one or more of the embodiments of the invention. As described herein above, this use can encompass one or more of the following steps:

- The wearing of a breast pad on the inside of the inner part of the inner bra when breastfeeding is not taking place;
- The sliding open of the first part and the second part of the inner bra for uncovering of the nipple during breastfeeding;
- The storing of the breast pad during breastfeeding in a breast pad holder present on the top part of the bra.

The use of the nursing bras according to the invention provides one or more of the following advantages compared to the use of nursing bras known in the state of the art: more discretion during breast feeding, easier access to the breast, a solution for the storing of a breast pad during the feeding and a complete shielding of the breast (and the milk) from the clothing. In particular embodiments of the nursing bra one or more of these advantages are ensured by the specific combinations of one or more of the following functions: a supporting function (amongst others by the features of the first part (2) of the inner bra), a covering function (amongst others by the presence of the first part (2) and primarily the second part (4) of the inner bra), a protective function against leaks (amongst others by the features of the top part (3) and the combination with the breast pad). Additionally, the nursing bras according to particular embodiments of the invention are more practical in use than the known designs, on the one hand due to the closing mechanism in the middle, the specific closing mechanism with click-system which provides resistance but can be opened one-handedly and/or due to the integrated breast pad holder which makes it possible to store (if necessary one-handedly) the breast pad during breastfeeding.

The invention will be further clarified based on the following description and the enclosed figures of particular embodiments.

FIG. 1 displays an overview of a particular embodiment of the bra according to the present invention.

FIG. 2 displays another overview of the bra of FIG. 1.

Figure 1:
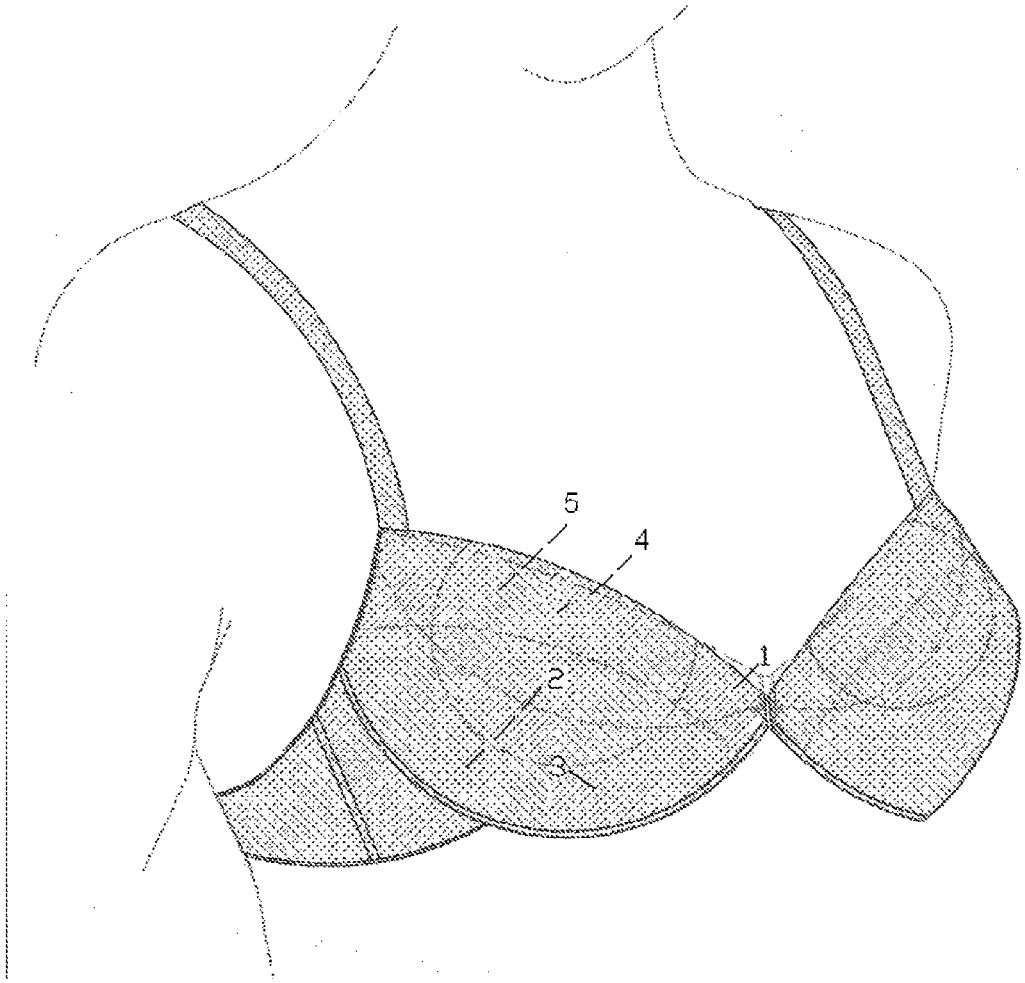
Figure 2:
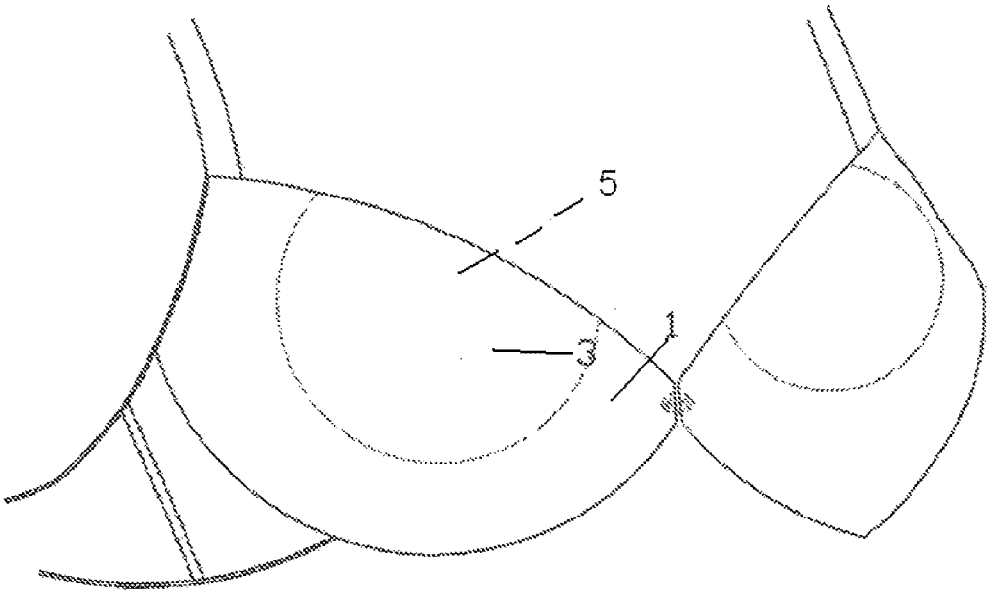

FIG. 1 as well as FIG. 2 show a nursing bra with two cups (1). FIG. 1 shows more particularly a nursing bra with at least one cup (1) for providing support to a breast, whereby the cup comprises a first part (2) for supporting the breast, with the feature that the cup is provided with a second part (4) which partly overlaps with the first part (2).

The bra shown in FIG. 1 is in closed state but shown as transparent such that the underlying parts (2), (3), (4) become visible. Each cup (1) is preferably provided with two parts: a first part (2) for supporting the breast and a second part (4) which covers the first part (2) at least in part. Although the two cups (1) are provided with these parts (2), (4), this is not a requirement for the invention and the shape, composition etc. of every cup (1) can be chosen independently from the other cup (1).

The second part (4) of the cup (1) is preferably provided such as to cover a part of the breast, not covered by the first part (2). The second part (4) can lie partly over the first part (2) but also partly under the first part (2). Preferably, the second part (4) lies over the first part (2).

The first (2) and second (4) part are preferably provided so as to be slid apart, such that, for instance upon breast feeding, the nipple of the breast can be pushed through the first (2) and the second (4) part. When no breastfeeding is taking place the whole of the first (2) and second (4) part can also cover the nipple.

Preferably the cup (1) comprises a top part (3) which covers at least part of the first (2) and/or second (4) part. The top part (3) is preferably attached to the bra that it can be folded away so as to expose the first (2) and second (4) part such hat the first (2) and second (4) part can be slid apart with the aim of pushing the nipple through for breastfeeding. Preferably the top part (3) is attached to the side part of the bra in a foldable manner. The top part (3) can preferably be detachably attached in the middle of the bra, preferably between the two cups (1), for instance by way of a button, click system, etc.

The inner side of the top part (3) preferably comprises means (5) for storing breast pads, for instance a net.

While both two cups (1) preferably comprise a top part (3), this is not essential for the invention and it is possible that only one cup (1) comprises a top part.

Figure 3:
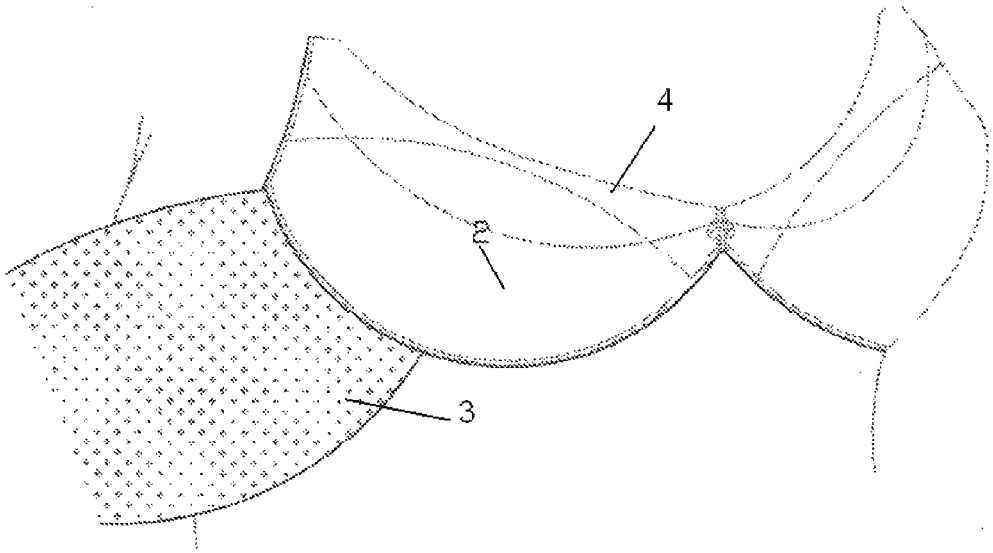
FIG. 3 shows an overview of the opened bra of FIG. 1.

FIG. 3 displays a schematic drawing of a nursing bra according to the invention in open state. More particularly FIG. 3 shows an embodiment in which the top part (3) is folded open and the first (2) and the second (4) part become visible. Between the first (2) and the second (4) part a small opening is provided in this embodiment. This opening is however not essential.

Figure 4:
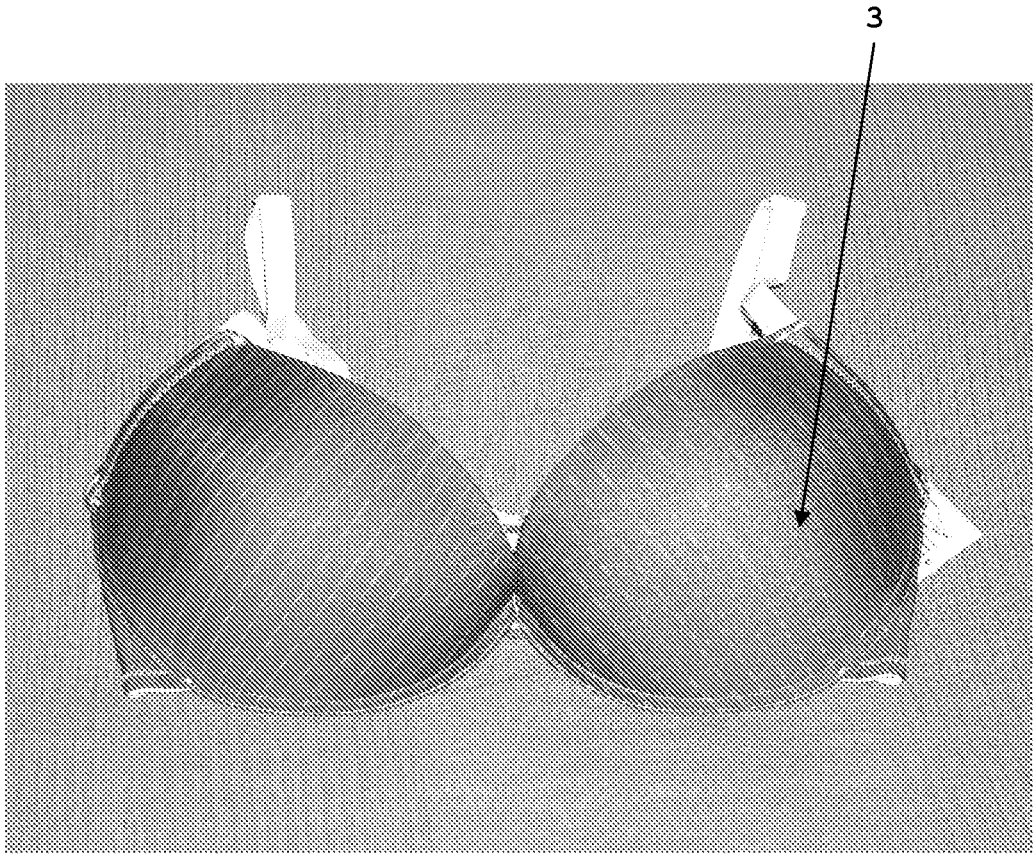
FIG. 4 shows a front view of the bra of FIG. 1.
Figure 8:
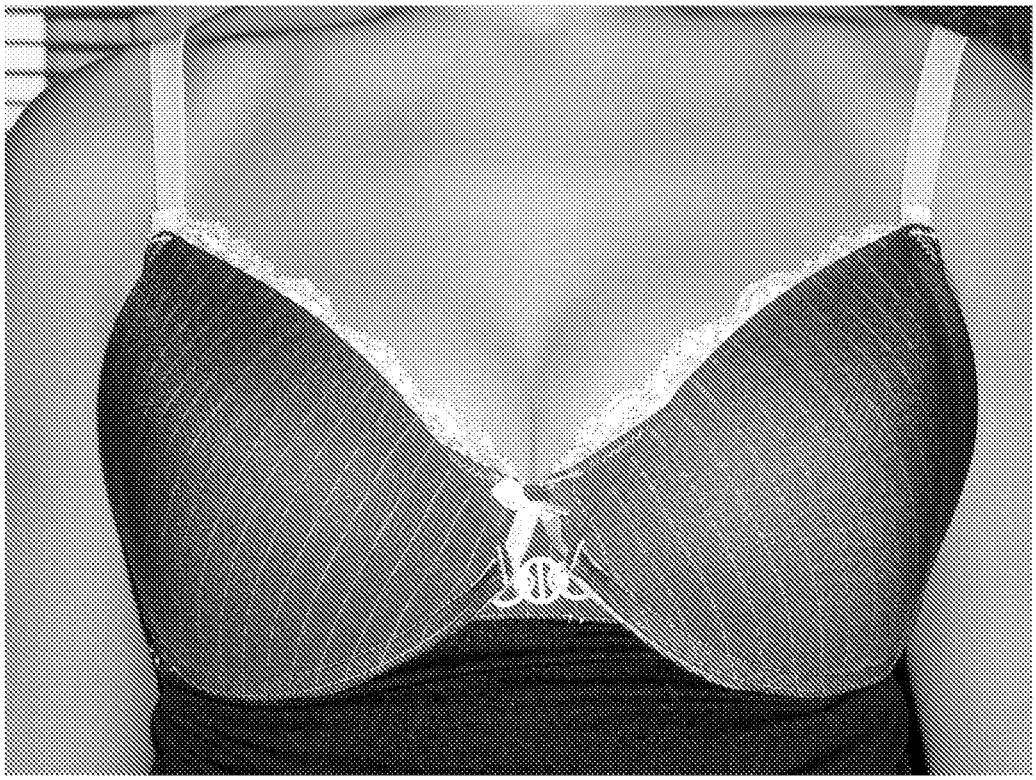
FIG. 8 shows a front view of FIG. 4.
Figure 9:
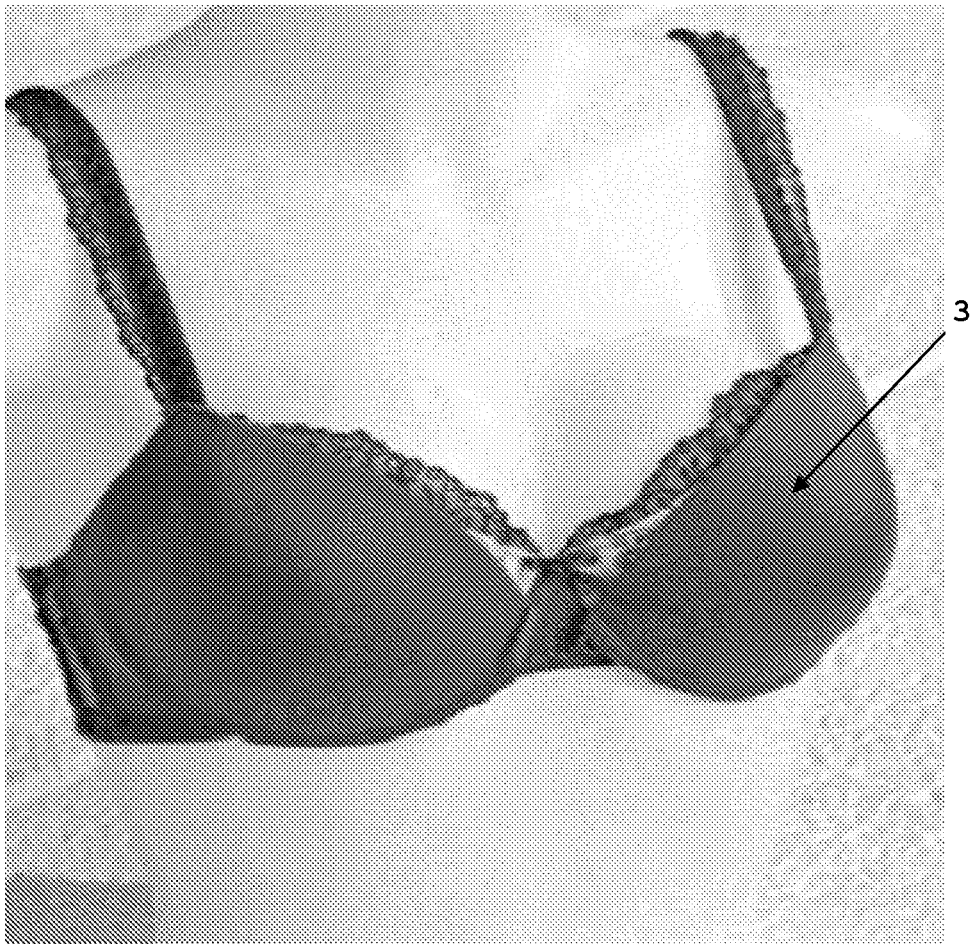
FIG. 9 shows a particular embodiment of the nursing bra according to the present invention in a closed state.

FIGS. 4, 8 and 9 show pictures of different embodiments of nursing bras according to the invention in the closed state. In the closed state the two top parts (3) are folded closed and attached by way of a closing mechanism in the middle of the bra between the two breasts. The top parts (3) are attached at the level of the middle of the inner bra and can be opened through a closing mechanism, more particularly a hook and tongue system, centrally on the inner bra between the two breasts. In the embodiments of FIGS. 4, 8 and 9 the top part (3) (almost) completely covers the cup of the inner bra, and thus the breast surface. Additionally the top parts (3) are provided on the outside with a thick fabric which matches with the fabric of the inner bra. The top parts are made in a relatively thick fiber such that they display a smooth shape of the breasts.

FIGS. 5, 6, 7, 10 and 11 show pictures of different embodiments of nursing bras according to the invention in the open state. In the open state the top parts (3) are folded open.

In the nursing bras according to the present invention, the first part (2) of the cup of the inner bra has both a supportive and a covering function. The supportive function is ensured in the embodiments of FIGS. 5 to 7, 10 and 11 by the presence of an under wire (10), which supports the breast. In these embodiments the first part (2) of the inner bra has an approximately triangular shape wherein one side (a) follows the bottom side of the breast, one side (b) (in fact covered by top part 3 in this picture) runs up along the side of the breast and one side (c) runs diagonally over the breast from the middle of the inner bra until about the level of the shoulder strap.

In the nursing bras according to the invention, the second part (4) of the cup of the inner bra has mainly a covering function. In the embodiments of FIGS. 5 to 7, 10 and 11 the shape of the second part of the inner bra is comparable to a rectangle with one concave side (d). The straight side (e) lies on the upper part of the breast and forms the cleavage or excision of the inner bra (and also of the nursing bra as a whole—see also FIG. 8).

Figure 5:
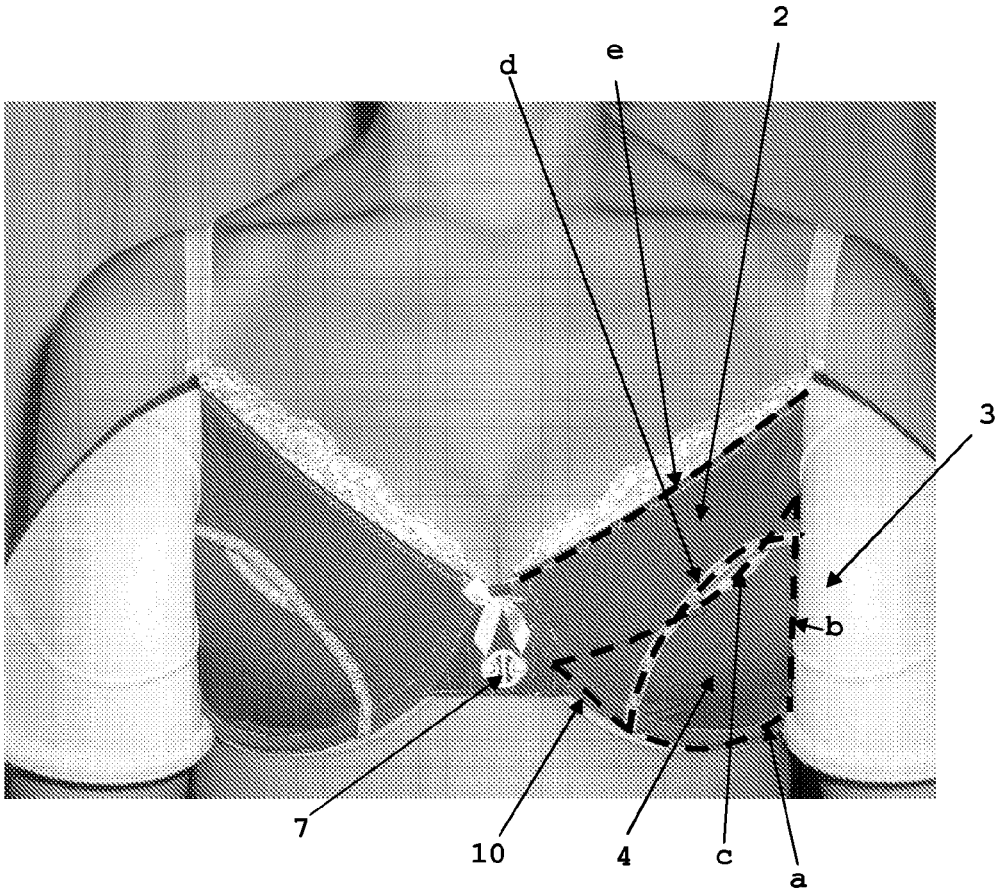
FIG. 5 shows another front view of the bra of FIG. 1.
Figure 6:
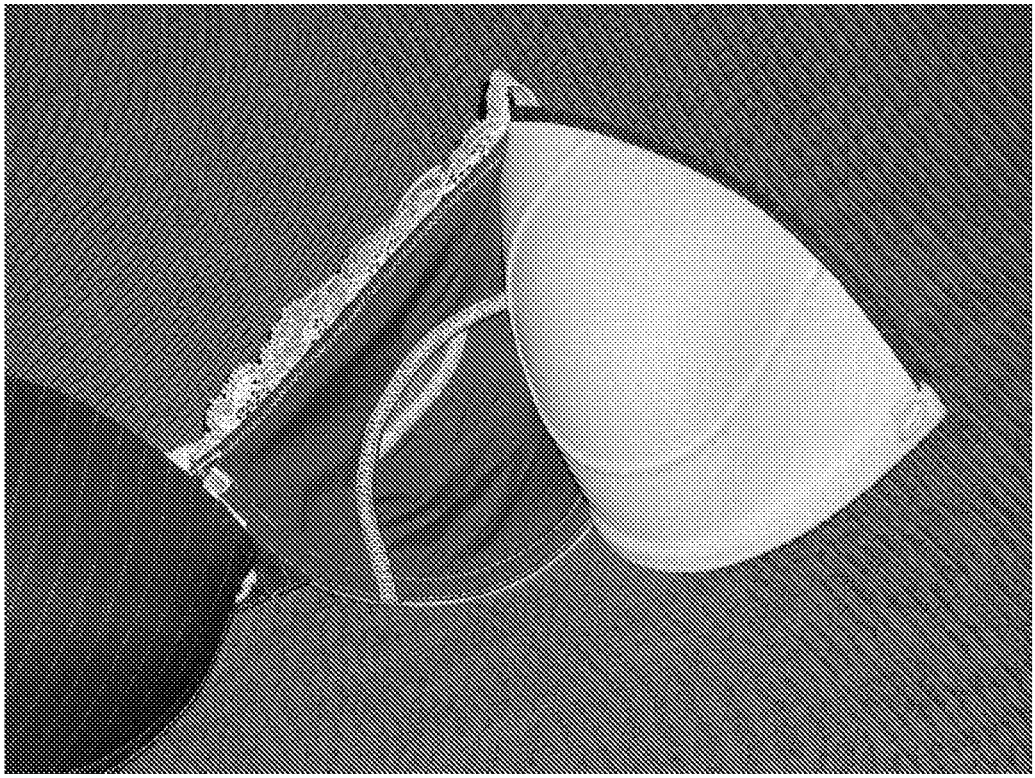
FIG. 6 shows a detail of a front view of FIG. 4.
Figure 7:
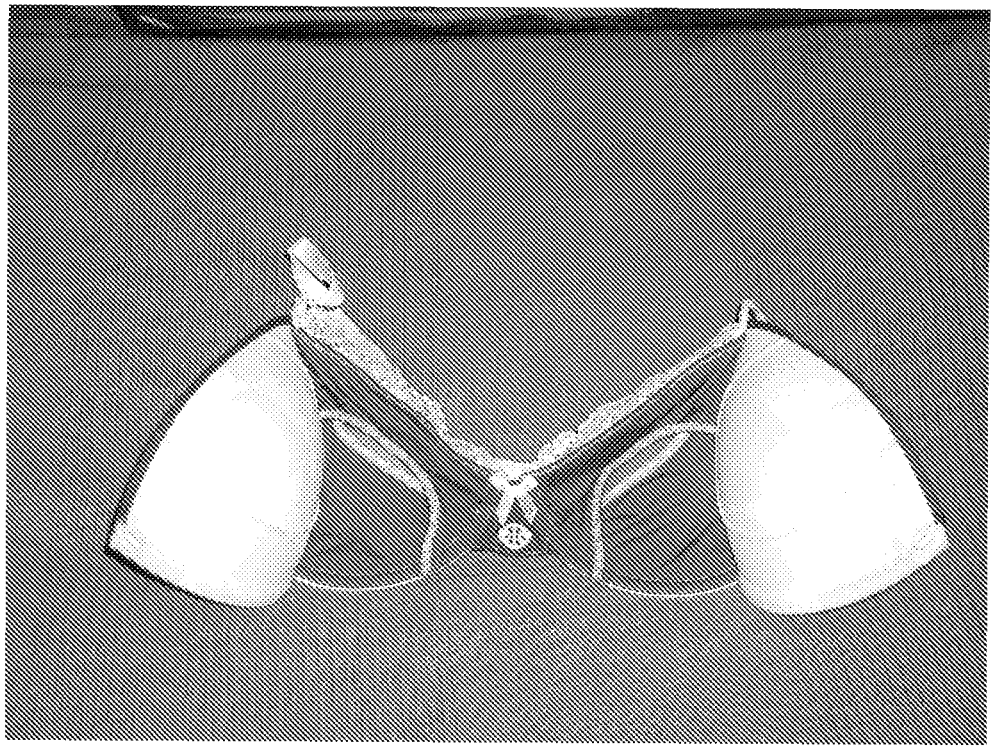
FIG. 7 shows another front view of FIG. 4.

In the embodiments of FIGS. 5 to 7 the two parts (2) and (4) of the inner bra cover the breast almost completely when the bra is being worn and no breastfeeding is taking place.

Figure 10:
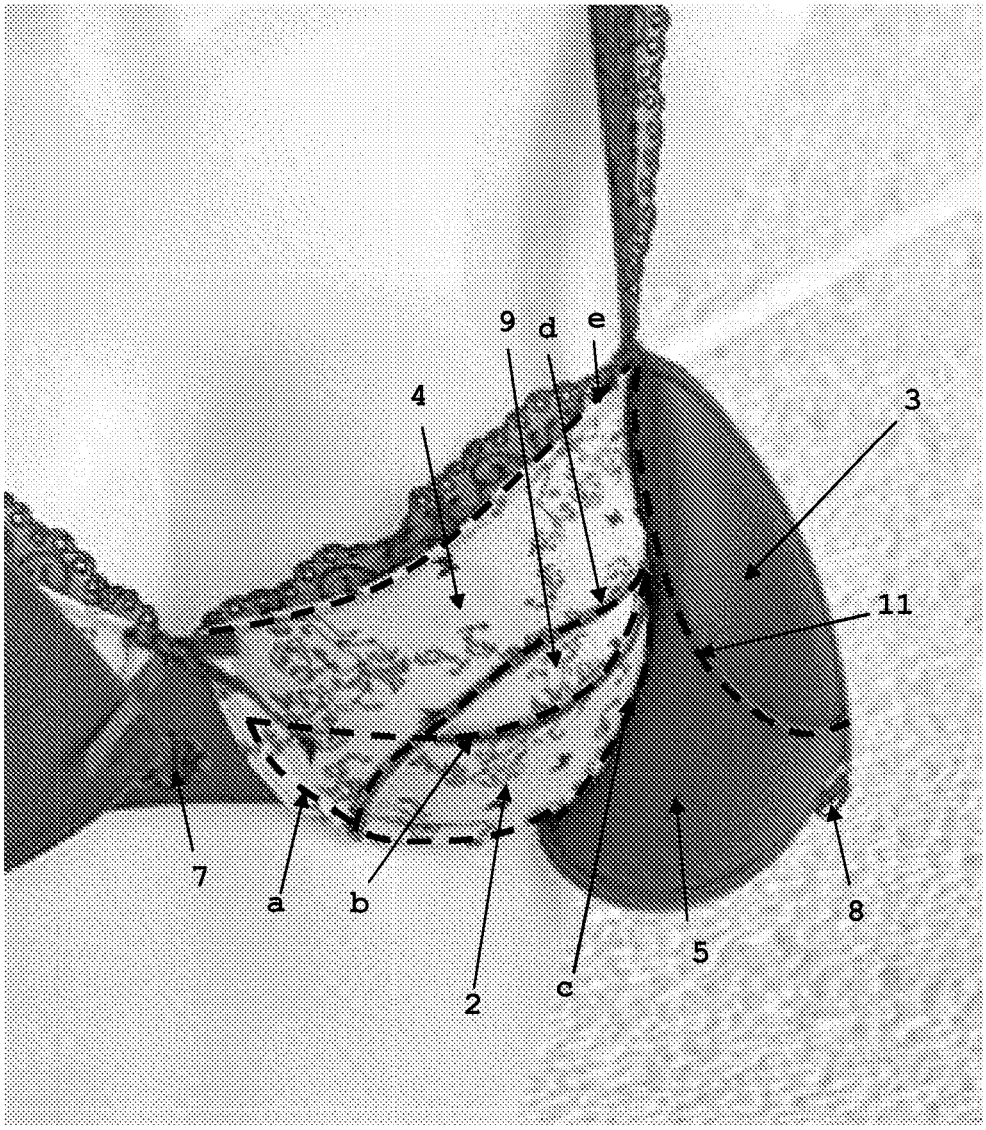
FIG. 10 shows a particular embodiment of the combination of a nursing bra and a breast pad according to the present invention; the nursing bra is shown in open state, but the breast pad is still places on the breast.
Figure 11:
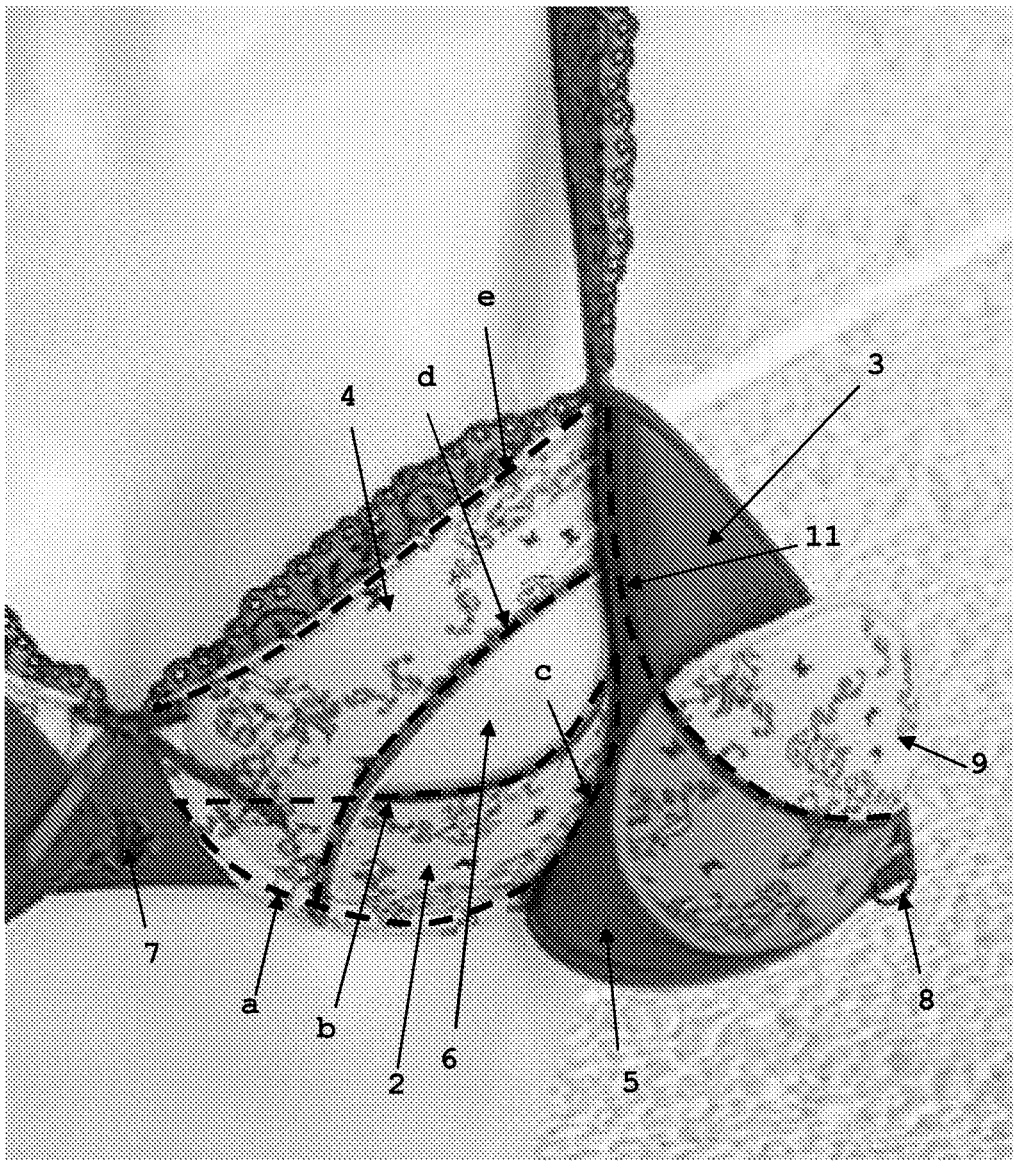
FIG. 11 shows a particular embodiment of the combination of a nursing bra and a breast pad according to the invention; the nursing bra is in open state, the breast pad has been removed from the breast and is stored in the breast pad holder of the corresponding top part.

In the embodiments of FIGS. 10 and 11 the two parts (2) and (4) of the inner bra cover the breast only partly, such that the two parts (2) and (4) of the inner bra from a opening (6) when the bra is being worn. When wearing a breast pad (9) in the inner bra this opening is covered by the breast pad (FIG. 10). When preparations are being made to breast feed the breast pad (9) is removed and stored in the breast pad holder (5) which is provided in a top part (3) of the nursing bra (FIG.

11). Breast pad holder (5) is attached to the inner side of the top part (3) and contains an opening (11) through which the breast pad can be slid inside.

In the embodiments of FIGS. 10 and 11 the combination of a nursing bra and a breast pad (9) according to the invention are illustrated, wherein the breast pad is provided on at least side with a fabric which is identical to the fabric of the outer side of the first part (2) and the second part (4) of the cup of the inner bra.

Figure 12:
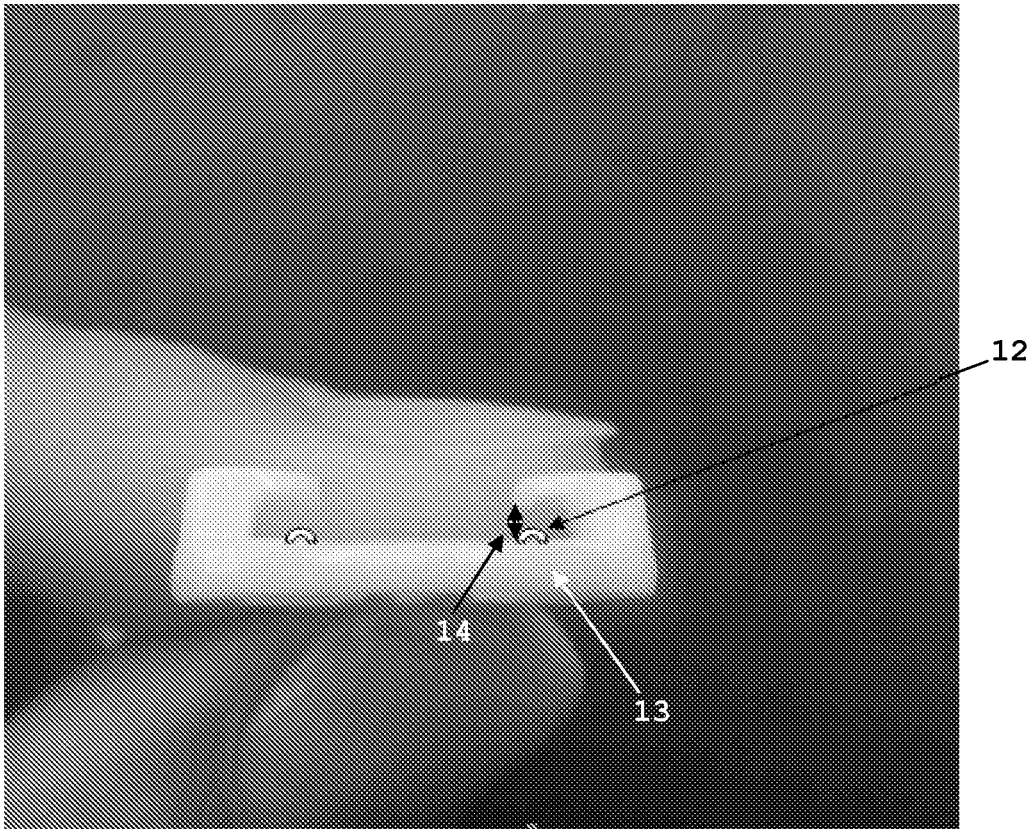
FIG. 12 shows a picture of a particular embodiment of a hook system of a bra closing mechanism according to the invention, whereby schematically the possibility is indicated of providing a ball-shaped element (12) on the hook system on the opposite side of the end of the hook.
Figure 13:
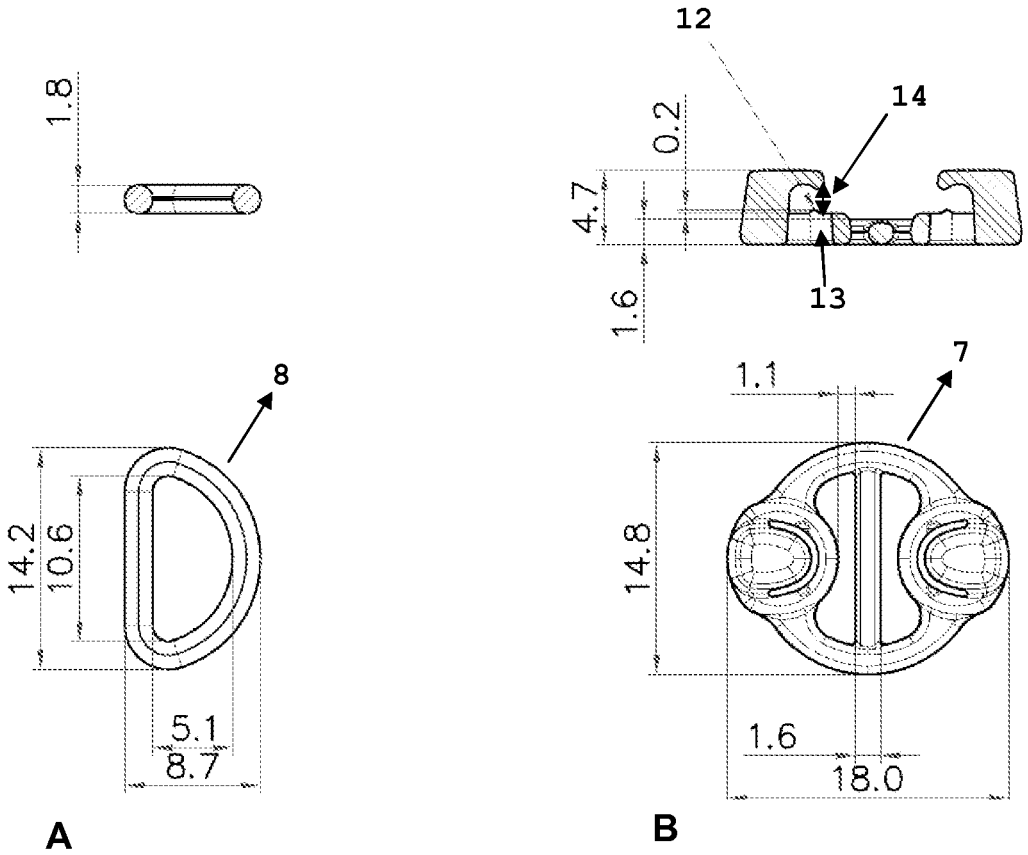
FIG. 13 shows a technical drawing of a cross section and a front view of a tongue system (A) and of a hook system (B) of a particular embodiment of the closing mechanism according to the invention, whereby the hook system is provided with a ball-shaped element (12) on the opposite side of the end of the hook.
Figure 14:
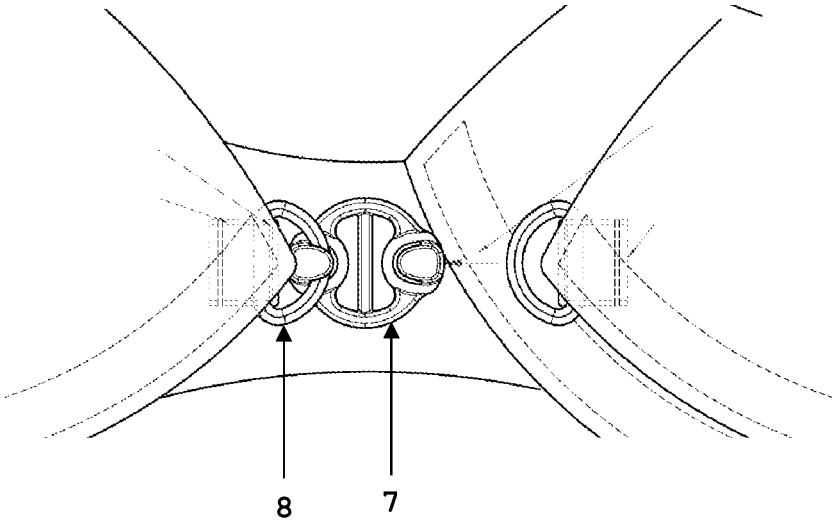
FIG. 14 shows a schematic top view of a tongue system (A) and of a hook system (B) of a particular embodiment of a closing mechanism according to the invention when it is provided onto a bra.

FIGS. 12, 13 and 14 show a detailed picture and technical drawings of particular embodiments of a closing mechanism of the bras according to the invention, comprising a hook (7) and tongue (8) system.

The hook system (7) is attached to the middle part of the nursing bra. The hook system (7) is adapted for closing of both top parts, i.e. for hooking in of two tongues. It consists of two hooks which are each oriented in an opposite direction, i.e. to one side part of the bra. Each of the two hooks is intended for hooking on of one top part (3) by way of a tongue (8). In this embodiment of the closing mechanism, each hook contains an additional recess on the under side which is formed by the presence of a ball-shaped element (12) which is positioned on the hook system on the opposite side of the end of the hook and forms an obstacle which reduces the opening (14) formed by the end of the hook and the base (13) of the hook system. The tongue system (8) consists in this embodiment of two small tabs each of which is attached on a top part (3) of the bra at the level of the middle of the bra in the closed state.

The invention claimed is:

1. A nursing bra comprising (a) an inner bra having two cups, wherein one cup of the inner bra comprises a first lower part for supporting the breast and a second upper part which partly overlaps said first lower part, whereby the first part and the second part are slidable to separate said breast covering parts for clearing at least said nipple of the breast for nursing; and (b) at least one top part overlying each one of said inner bra cups said top part openable and closeable by attaching a closing mechanism located on a lateral side of said top part, said lateral side lying centrally on the inner bra between said two inner bra cups.

2. The nursing bra according to claim 1, wherein the top part at least partially covers the first part and the second part of the inner bra.

3. The nursing bra according to claim 1 characterized in that the top part comprises means for storing a breast pad.

4. The nursing bra according to claim 1, characterized in that the first part comprises an inner side having an additional layer of fabric for providing additional support.

5. The nursing bra according to claim 1, characterized in that the first part extends from a shoulder strap of the nursing bra.

6. The nursing bra according to claim 1, characterized in that said first part of said inner bra cup supports the breast by the presence of an under wire on said first part, which follows shape of a bottom side of the wearer's breast and extends outwardly and upwardly in the direction of the wearer's adjacent armpit.

7. The nursing bra according to claim 1 characterized in that each top part has an inner side to which a lining is attached.

8. The nursing bra according to claim 1 characterized in that the closing mechanism of each of said top part is a hook and tongue system.

9. A combination of a nursing bra according to claim 1 and one or more breast pads.

10. The combination according to claim 9, wherein the inner bra and/or the top parts comprise a fabric and each of said breast pads comprises fabric which is identical to said fabric of the inner bra and/or the top parts of the nursing bra.

11. A method for supporting and/or covering of the breasts during nursing, said method comprising the steps of wearing said nursing bra as claimed in claim 1, opening at least one of said top parts and sliding apart said first part and said second part of said inner bra for clearing at least said wearer's nipple of the breast.

12. The nursing bra according to claim 8, wherein the closing mechanism comprises a recess below the hook.

13. A nursing bra comprising (a) an inner bra having two cups, wherein each cup comprises a first part for supporting a breast and a second part that partly overlaps the first part, whereby the first part and the second part are slidable apart for exposing at least the nipple of the breast for nursing, and a central portion between the two cups, wherein the central portion comprises one component of a fastener; and (b) a top part that covers at least a portion of each cup, wherein a medial portion of the top part that covers each cup comprises a complementary second component of a fastener for fastening the top part to the first fastener attached to the central portion of the inner bra and wherein the top part covering each cup is openable by way of unfastening the fasteners.

14. A nursing bra comprising (a) an inner bra having two cups, wherein each cup comprises a first lower part for supporting a breast and a second upper part that partly overlaps the first part, whereby the first part and the second part are slidable apart for exposing at least the nipple of the wearer's breast for nursing; and (b) at least one top part comprising means for storing a removable breast pad, wherein the top part is openable and closeable by attaching a closing mechanism located on a lateral side of said top, said lateral side lying centrally on the inner bra between said two inner bra cups.

* * * * *